US008213268B2

(12) United States Patent
Kato et al.

(10) Patent No.: US 8,213,268 B2
(45) Date of Patent: Jul. 3, 2012

(54) CHRONOGRAPH TIMEPIECE

(75) Inventors: Kazuo Kato, Chiba (JP); Akira Takakura, Chiba (JP); Kenji Ogasawara, Chiba (JP); Saburo Manaka, Chiba (JP); Kazumi Sakumoto, Chiba (JP); Hiroshi Shimizu, Chiba (JP); Tomohiro Ihashi, Chiba (JP); Keishi Honmura, Chiba (JP); Takanori Hasegawa, Chiba (JP); Kosuke Yamamoto, Chiba (JP); Eriko Noguchi, Chiba (JP)

(73) Assignee: Seiko Instruments Inc. (JP)

( * ) Notice: Subject to any disclaimer, the term of this patent is extended or adjusted under 35 U.S.C. 154(b) by 161 days.

(21) Appl. No.: 12/804,138

(22) Filed: Jul. 14, 2010

(65) Prior Publication Data

US 2011/0026372 A1 Feb. 3, 2011

(30) Foreign Application Priority Data

Jul. 16, 2009 (JP) ..... 2009-168255

(51) Int. Cl.
*G04F 8/00* (2006.01)
*G04F 10/00* (2006.01)

(52) U.S. Cl. ..... 368/112; 368/157

(58) Field of Classification Search ..... 368/110–113, 368/155–157
See application file for complete search history.

(56) References Cited

U.S. PATENT DOCUMENTS 4,176,516 A * 12/1979 Kodama ..... 368/187
4,440,502 A 4/1984 Kanno ..... 368/80
4,470,706 A * 9/1984 Nishimura et al. ..... 368/74
4,623,260 A 11/1986 Kamiyama ..... 368/80
5,335,211 A * 8/1994 Muto et al. ..... 368/11
6,163,126 A * 12/2000 Kojima et al. ..... 318/685
6,327,225 B1 * 12/2001 Okeya et al. ..... 368/157
6,466,518 B1 * 10/2002 Akahane et al. ..... 368/64
RE40,370 E * 6/2008 Sato et al. ..... 368/157
2002/0186622 A1 * 12/2002 Ogasawara ..... 368/157
2003/0001539 A1 1/2003 Hanzaki ..... 318/811
2008/0084792 A1 * 4/2008 Hayashi et al. ..... 368/80

OTHER PUBLICATIONS

Abstract, publication No. 2003-185765, publication date Jul. 3, 2003.
Abstract, publication No. 2005-003493, publication date Jan. 6, 2005.
Abstract, publication No. 2006-090769, publication date Apr. 6, 2006.

* cited by examiner

*Primary Examiner* — Vit Miska
(74) *Attorney, Agent, or Firm* — Adams & Wilks

(57) ABSTRACT

Disclosed is a chronograph timepiece in which it is possible to prevent a non-rotation state at the time of first driving when chronograph measuring operation is reset during motor drive and restarting is effected. When a resetting operation is performed on a reset button during the driving of a motor and a rotation detection circuit detects non-rotation, a drive control unit controls a drive pulse generation circuit such that the control is completed without reversing the polarity of a motor drive pulse output from the drive pulse generation circuit, and that the motor is driven by a drive pulse of the same polarity as that at the time of the previous resetting in response to a starting operation performed on a start/stop button, driving the motor by the drive pulse of the same polarity at the time of restarting after the resetting.

2 Claims, 5 Drawing Sheets

CHRONOGRAPH TIMEPIECE

BACKGROUND OF THE INVENTION

1. Field of the Invention

The present invention relates to a chronograph timepiece having a time indicating function and a time measuring function.

2. Description of the Related Art

Conventionally, there has been developed a chronograph timepiece in which a plurality of drive motors are mounted in order to individually drive a plurality of indicator hands and which is endowed with a time indicating function as a basic function and, further, a chronograph measuring function for performing time measurement, wherein the driving of the indicator hands is electrically effected by the drive motors, and the zero-restoring of the chronograph hands is effected by a mechanical mechanism such as hearts (See, for example, JP-A-2005-3493 and JP-A-61-73085 regarding the chronograph timepiece, and JP-A-2003-185765 regarding the motors).

For example, in the chronograph timepiece as disclosed in JP-A-61-73085, when a reset button is depressed during chronograph measuring operation (FIG. 11), a contact portion 305 is placed in a contact state, and a hammer 128 rotates a hammer operating lever 280, effecting the zero-restoring of the chronograph hands by hearts 281 and 291. In the case in which drive pulses for chronograph hand drive are being output when the contact point 305 is placed in a contact state and a chronograph reset signal is input, the timing of the setting by the hearts and the timing of the drive pulses overlap each other to thereby place a stepping motor in a non-rotation state. Even if rotation detection is effected to detect the non-rotation, a correction drive pulse is allowed to be output immediately thereafter. As a result, solely the polarity of the drive pulses stored in an integrated circuit (IC) is reversed, with the chronograph motor not rotating; thus, when chronograph measurement is restarted, the stepping motor does not rotate at the time of the first drive.

On the other hand, JP-A-2006-90769 discloses a chronograph timepiece equipped with a mechanical safety mechanism which prevents resetting from being effected even if resetting operation is performed during chronograph operation; in the above-mentioned chronograph timepiece, however, the mechanical mechanism is rather complicated, and a high cost is involved.

JP-A-2003-4872 and JP-A-59-20885 disclose inventions according to which hand movement is stopped through detection of rotation. JP-A-2003-4872 discloses an analog electronic timepiece in which hand movement is stopped when the result of the detection of rotation at the time of correction drive is non-rotation. In order to prevent abnormal wear and breakage, when the result of the detection of rotation after normal hand movement pulse drive is non-rotation, correction drive pulse drive is conducted, and the hand movement is stopped when the result of the detection of rotation effected again is non-rotation. Further, JP-A-59-20885 discloses an electronic timepiece which is equipped with a second hand drive motor and an hour/minute drive motor, wherein, in order to inform the user of any abnormality, when non-rotation of the rotor of the hour/minute drive motor is detected, the driving of the second hand drive motor is stopped. None of the above-mentioned inventions helps to solve the problem of non-rotation at the time of restarting.

SUMMARY OF THE INVENTION

It is an aspect of the present invention to prevent a non-rotation state at the time of first driving when chronograph measuring operation is reset during motor drive and restarting is effected.

According to the present invention, there is provided a chronograph timepiece comprising: a chronograph hand indicating time measured at the time of chronograph measurement; a stepping motor rotating the chronograph hand; an operating unit performing operations of starting, stopping, and resetting chronograph measurement; a rotation detecting unit detecting whether the stepping motor has rotated or not; a drive control unit which drive-controls the stepping motor in response to the operation by the operating unit and which drive-controls the stepping motor by a drive pulse in accordance with a detection result obtained by the rotation detecting unit; and a resetting unit which mechanically zero-restores and retains the chronograph hand in response to the resetting operation by the operating unit and which electrically resets chronograph measurement operation, wherein, when the resetting operation by the operating unit is conducted at the time of driving the stepping motor, and the rotation detecting unit detects non-rotation, the drive control unit drive-controls the stepping motor by a drive pulse of the same polarity as that at the time of the previous resetting in response to the restarting operation by the operating unit.

In the chronograph timepiece of the present invention, it is possible to prevent a non-rotation state at the time of first driving when chronograph measuring operation is reset during motor drive and restarting is effected.

DETAILED DESCRIPTION OF THE PREFERRED EMBODIMENTS

Figure 3:
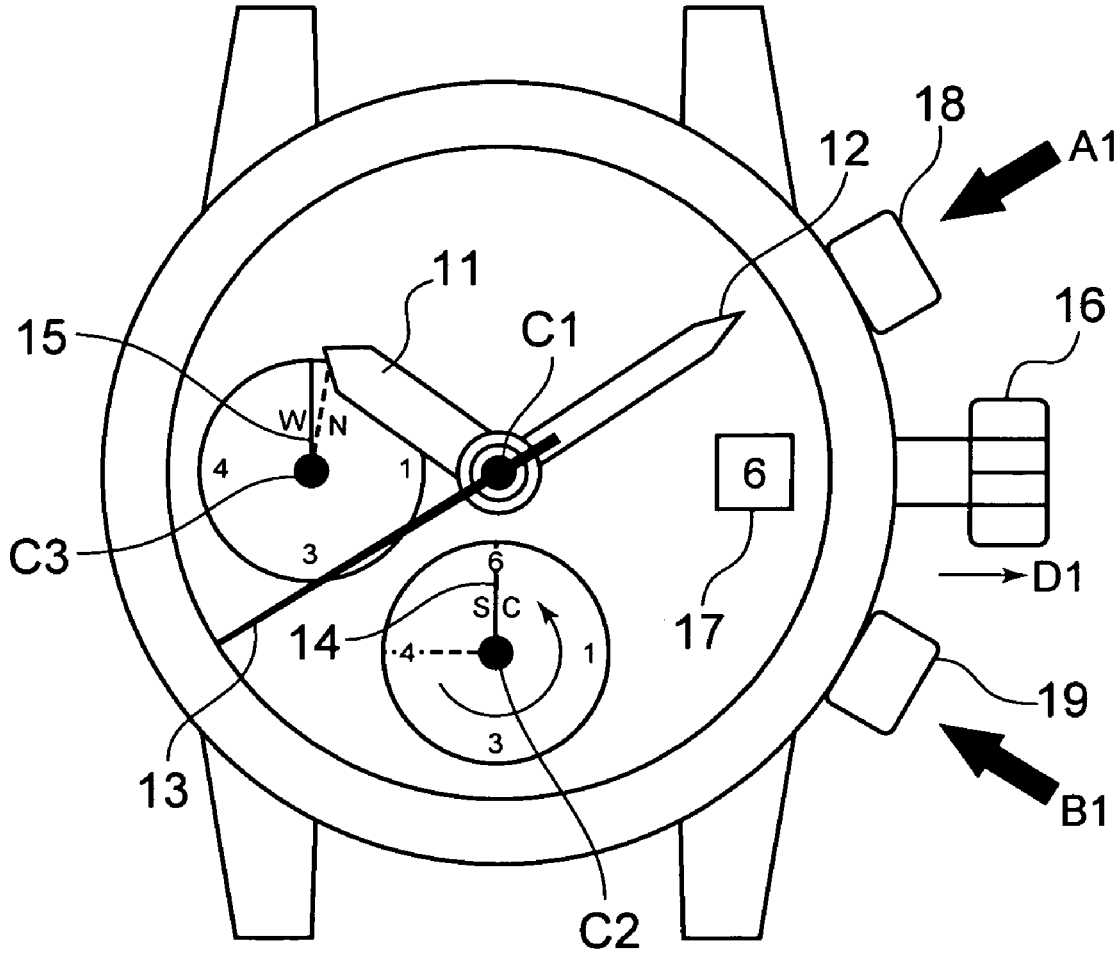
FIG. 3 is a plan view of the exterior appearance of a chronograph timepiece according to an embodiment of the present invention.

As shown in FIG. 3, a chronograph timepiece 1 according to an embodiment of the present invention is in the form of a wristwatch, and is equipped with time hands rotated around a center axis C1 and adapted to indicate the current time (an hour hand 11, a minute hand 12, and a second hand 13), and chronograph hands (a chronograph second hand 14 rotated around a center axis C2 and a chronograph minute hand 15 rotated around a center axis C3).

For example, by turning a winding stem 16 in a state in which it has been drawn out by two steps in a direction D1, it is possible to rotate the time hands 11 through 13, and, by turning the winding stem 16 in a state in which it has been drawn out by one step in the direction D1, it is possible to change a date 17 of a date indicator displayed through a window. The operation of the chronograph timepiece 1 related to normal time display is the same as that of an ordinary electronic timepiece, and is well known by those skilled in the art, so that, in the following, a description of the structure, function, and operation related to normal hand movement will be omitted.

In the chronograph timepiece 1, the chronograph hands 14 and 15 are electrically drive-controlled by a stepping motor, and zero-restoring-controlled by a mechanical construction.

In the chronograph timepiece 1, by depressing a start/stop button 18 in a direction A1, there is given an instruction to start/stop chronograph operation by the chronograph timepiece 1. More specifically, the starting/stopping of the chronograph operation implies the starting/stopping of the movement of the chronograph hands 14 and 15; as described below, in this connection, there are effected the operation of an electrical drive system and the retention of electrical positional information on the chronograph hands. In some cases, however, there is no need for the electrical positional information on the chronograph hands to be retained. The start/stop button 18 and a reset button 19 constitute operating units.

In the chronograph timepiece 1, by depressing the reset button 19 in a direction B1, there is given an instruction to effect resetting of the chronograph operation, that is, restoring (zero-restoring) to an initial state by the chronograph timepiece 1. More specifically, the resetting of the chronograph operation implies forcible restoring (zero-restoring) to the initial positions (time indicating positions) of the chronograph hands 14 and 15, the setting of the movement of the chronograph hands 14 and 15, and the resetting of the electrical positional information on the chronograph hands.

First, a mechanical structure 5 and an operation related to the starting, hand movement, and zero-restoring of the chronograph timepiece 1 will be described mainly with reference to FIGS. 2A and 2B. The mechanical structure 5 related to the starting, hand movement, and zero-restoring of the chronograph timepiece 1 is also briefly shown in the left-hand side portion of the block diagram of FIG. 1.

Apart from a motor (not shown) for normal hand movement (time hand movement), the chronograph timepiece 1 is equipped with a chronograph hand movement motor 35; when rotated, the chronograph hand movement motor 35 moves the chronograph hands 14 and 15 via a chronograph hand movement train wheel 36.

The normal hand movement motor and the chronograph hand movement motor 35 are stepping motors for timepieces of a well-known construction (See, for example, JP-A-61-73085). Each of the stepping motors comprises a stator having a rotor accommodating hole and a positioning portion determining a rotor stop position, a rotor arranged inside the rotor accommodating hole, and a drive coil; alternating signals (drive pulses) of alternately different polarities are supplied to the drive coil to generate a magnetic flux in the stator, and the rotor is rotated and is stopped at a position corresponding to the positioning portion. By being alternately driven by the drive pulses of different polarities, the rotor rotates continuously by a predetermined angle (e.g., 180 degrees) at one time; even when the driving is continuously effected by a plurality of in-phase drive pulses, in the case in which rotation is effected by the first drive pulse, no rotation is caused by the second in-phase drive pulse onward.

The chronograph timepiece 1 is equipped with a chronograph second cam 22 mounted to a chronograph second arbor 21 with the chronograph second hand 14, and a chronograph minute cam 24 mounted to a chronograph minute arbor 23 with the chronograph minute hand 15.

Further, the chronograph timepiece 1 is equipped with a hammer operating first lever (hereinafter also referred to as the "hammer operating lever B") 25, a hammer operating second lever (hereinafter also referred to as the "hammer operating lever A") 26, a hammer 27, and a stop lever 28.

The chronograph second cam 22, the chronograph minute cam 24, and the hammer 27 constitute a setting mechanism, and the hammer operating second lever 26 and the hammer 27 constitute a releasing unit. Further, the chronograph second cam 22, the chronograph minute cam 24, the hammer 27, the hammer operating first lever 25, and the hammer operating second lever 26 constitute a mechanical resetting unit. Further, the hammer operating first lever 25, the hammer operating second lever 26, and the hammer 27 constitute a lever unit.

The hammer operating first lever 25 is rotatable between a reference position J1 (indicated by the solid line in FIG. 2B) and a zero-restoring position J2 (indicated by the solid line in FIG. 2A and by the dotted line in FIG. 2B); a positioning pin 25*a* is engaged with a spring-like positioning member 29 equipped with an engaging groove, whereby positioning is effected thereon at the reference position J1 or the zero-restoring operation position J2. An elongated hole 26*a* of the hammer operating second lever 26 is engaged with a pin 25*b* of the hammer operating first lever 25. When the hammer operating first lever 25 is moved from the reference position J1 to the zero-restoring position J2 and set in position, the hammer operating second lever 26 is moved from a reference position K1 (indicated by the solid line in FIG. 2B) to a zero-restoring position K2 (indicated by the solid line in FIG. 2A and by the dotted line in FIG. 2B).

On the other hand, when the hammer operating second lever 26 is moved from the zero-restoring position K2 to the reference position K1 and set in position, the hammer operating first lever 25 is moved from the zero-restoring position J2 to the reference position J1 and set in position.

Figure 2A:
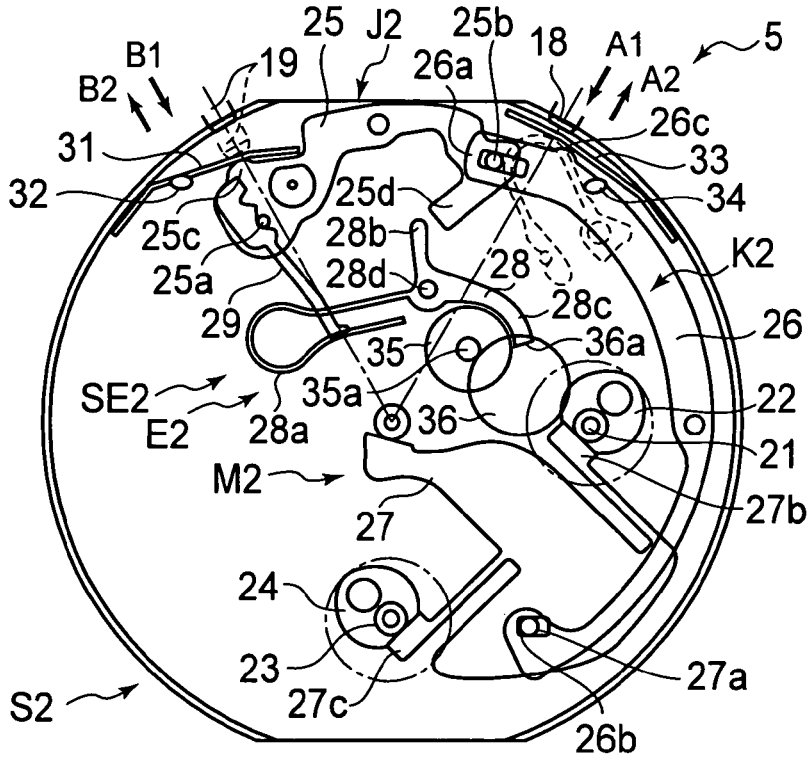
FIGS. 2A and 2B are plan views schematically showing the mechanical construction of a chronograph mechanism of a chronograph timepiece according to an embodiment of the present invention.
Figure 2B:
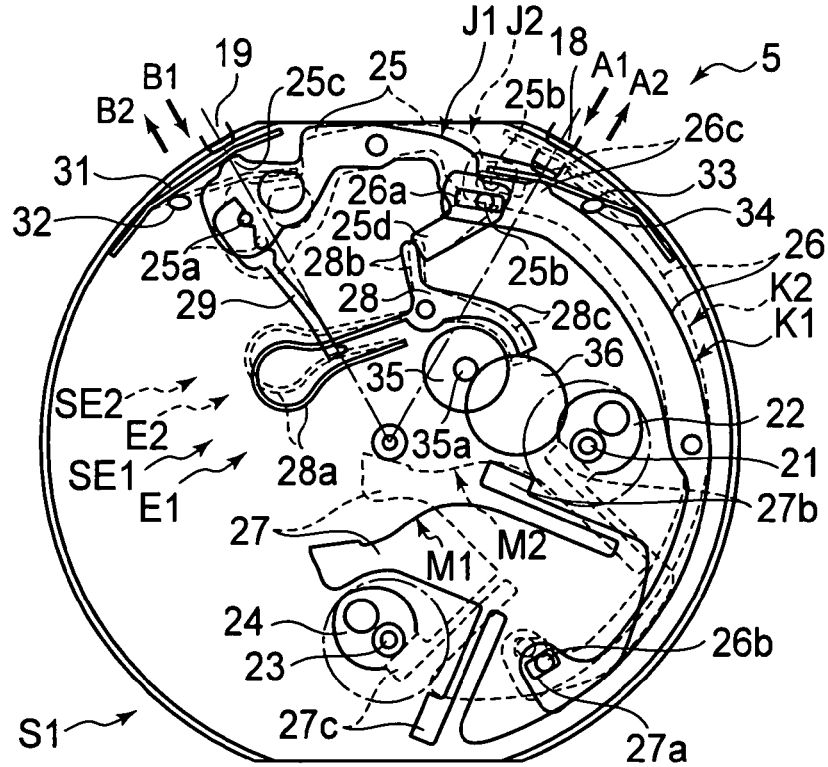

An elongated hole 27*a* of the hammer 27 is engaged with a pin 26*b* of the hammer operating second lever 26, and, in accordance with the position setting of the hammer operating second lever 26 to the reference position K1 or the zero-restoring position K2, positioning is effected thereon at a reference position M1 (indicated by the solid line in FIG. 2B) or a zero-restoring position M2 (indicated by the solid line in FIG. 2A and by the dotted line in FIG. 2B).

When the hammer 27 is set at the zero-restoring position M2, a second hammer portion 27*b* of the hammer 27 strikes the chronograph second cam 22 to zero-restore the chronograph second hand 14 to the initial position, and a minute hammer portion 27*c* thereof strikes the chronograph minute cam 24 to zero-restore the chronograph minute hand 15 to the initial position.

The stop lever 28 is equipped with a spring portion 28*a*, an engagement arm portion 28*b*, and a lock arm portion 28*c*, and is rotatable around a pin 28*d* between a correction control position at the time of zero-restoring or a setting position E2 (indicated by the solid line in FIG. 2A and by the dotted line in FIG. 2B) and a correction control cancelling position or a setting releasing position E1 (indicated by the solid line in FIG. 2B). In a state SE2 in which the stop lever 28 is at the setting position E2, the lock arm portion 28*c* of the stop lever 28 is engaged with one wheel 36*a* of the chronograph hand movement train wheel 36 connected to a rotor cogwheel 35*a* of the chronograph hand movement motor 35 to effect setting on the rotation of the train wheel 36, and, in a state SE1 in which the stop lever 28 is at the setting releasing position E1, it is separated from the wheel 36*a* of the train wheel 36 to permit rotation of the rotor cogwheel 35*a* of the motor 35 and of the train wheel 36.

When the hammer operating first lever 25 is rotated and displaced from the zero-restoring position J2 to the reference position J1, the engagement arm portion 28*b* of the stop lever 28, whose spring portion 28*a* is under a biasing force toward the setting position E2, is engaged with an arm portion 25*d* of the hammer operating first lever 25, and is rotated and displaced from the setting position at the time of zero-restoring E2 to the setting releasing position E1. On the other hand, when the hammer operating first lever 25 is moved from the reference position J1 to the zero-restoring position J2, the engagement of the arm portion 25*d* of the hammer operating first lever 25 and the engagement arm portion 28*b* is released, so that the stop lever 28 is restored from the setting releasing position E1 to the setting position E2 by the spring force of the spring portion 28*a* of the stop lever 28.

When the start/stop button 18 is depressed in the direction A1, with the chronograph timepiece 1 being in a zero-restored (reset) state S2 shown in FIG. 2A, a protrusion 26*c* of the hammer operating second lever 26 is pressed in the direction A1 to cause the hammer to be displaced from the position K2 to the position K1, and, at the same time, the hammer operating first lever 25 is displaced from the position J2 to the position J1, with the hammer 27 being displaced from the position M2 to the position M1. As a result, the rotation setting (zero-restoring control) on the hearts 22 and 24 and the chronograph hands 14 and 15 by hammer portions 27*b* and 27*c* is released. Further, in response to the rotation of the hammer operating first lever 25 from the position J2 to the position J1, the stop lever 28, whose arm portion 28*b* is engaged with the arm portion 25*d* of the hammer operating first lever 25, is rotated from the setting position E2 to the setting releasing position E1, and the lock arm portion 28*c* of the stop lever 28 is separated from the chronograph train wheel 36 to release the rotation setting (stop control) on the train wheel 36. As a result, the mechanical control mechanism 5 is restored to the state S1, and the chronograph hands 14 and 15 become rotatable.

On the other hand, when the reset button 19 is depressed in the direction B1, with the chronograph timepiece 1 being in the start state or hand movement state S1 shown in FIG. 2B, the protrusion 25*c* of the hammer operating first lever 25 is depressed in the direction B1, and the hammer operating first lever 25 is displaced from the position J1 to the position J2. When the hammer operating first lever 25 is displaced from the position J1 to the position J2, the hammer operating second lever 26 engaged with the lever 25 is moved from the position K1 to the position K2 on the one hand, and the hammer 27 engaged with the lever 26 is moved from the position M1 to the position M2, with the second hammer 27*b* and the minute hammer 27*c* striking the second heart 22 and the minute heart 24 to zero-restore the chronograph second hand 14 and the chronograph minute hand 15; on the other hand, the lock of the arm portion 25*d* with respect to the stop lever 28 is released, and the stop lever 28 is rotated from the position E1 to the position E2 to cause the arm portion 28*c* to be engaged with the chronograph train wheel 36, thereby effecting setting on the train wheel 36.

Regarding the chronograph timepiece 1, the electrical aspect with regard to the mechanical structure 5 shown in FIGS. 2A and 2B are as follows.

When the start/stop button 18 is depressed in the direction A1, with the chronograph timepiece 1 being in the reset state S2 shown in FIG. 2A, the start/stop button 18 presses a start/stop switch spring 33 exerting a biasing force in a direction A2 in the vicinity of the depth end thereof to thereby close a contact portion 34, generating a start signal Pa (FIG. 1) via the contact portion 34. When the start/stop button 18 is depressed in the direction A1, with the chronograph timepiece 1 being in the start state S1 shown in FIG. 2B, the start/stop button 18 presses the start/stop switch spring 33 to thereby close the contact portion 34, generating a stop signal Pb (FIG. 1) via the contact portion 34.

On the other hand, when the reset button 19 is depressed in the direction B1, with the chronograph timepiece 1 being in the start state (or stop state) S1 shown in FIG. 2B, the reset button 19 presses a reset switch spring 31 exerting a biasing force in a direction B2 in the vicinity of the depth end thereof to thereby close a contact portion 32, generating a reset signal Qa (FIG. 1) via the contact portion 32.

In the following, of the above operations, the start and progress of a starting operation when the start/stop button 18 is depressed in the direction A1 in the zero-restored state S2 of FIG. 2A will mainly be described in more detail.

As the start/stop button 18 is depressed in the direction A1, the electrical drive start signal Pa is output via the switch contact 34 on the one hand to thereby rotate the motor 35; on the other hand, the mechanical zero-restoring control state is released through rotation of the hammer 27 caused by the rotation of the hammer operating second lever 26, and, at the same time, the lock (stop control state) of the train wheel 36 is released through rotation of the stop lever 28 caused by the rotation of the hammer operating second lever 26 and the hammer operating first lever 25, thus mechanically permitting hand movement (i.e., releasing the mechanical setting).

Here, in order for the chronograph timepiece 1 to properly operate and for time measurement to be conducted accurately, it is necessary for the motor 35 to be rotated after the completion of the releasing of the mechanical setting. In the chronograph timepiece 1, the electrical drive is reliably effected after the completion of the releasing of the mechanical setting while avoiding complication of the structure and an increase in cost involved. In the following, this will be mainly described in detail.

Next, the outline of an electrical drive mechanism 6 of the chronograph timepiece 1 will be described mainly with reference to the block diagram of FIG. 1 while also referring to the mechanical structure 5 of FIGS. 2A and 2B.

The rotation of the chronograph hand movement motor 35 of the chronograph timepiece 1 is controlled by a drive control integrated circuit 50 for the chronograph hand movement motor 35 drive-controlled based on clock pulses imparted via an oscillator circuit 41 and a frequency divider circuit 42.

The motor drive control integrated circuit 50 has a basic drive control unit 51, a drive pulse generation circuit 52, a motor drive circuit 53, a zero-restoring control unit 54, and a rotation detection circuit 55. Here, a drive unit for the chronograph hand movement motor 35 consists of the motor drive circuit 53, and a drive control unit for the chronograph hand movement motor 35 has the basic drive control unit 51, the drive pulse generation circuit 52, the motor drive circuit 53, and the rotation detection circuit 55. The zero-restoring control unit 54 constitutes an electrical resetting unit for effecting electrical resetting, and constitutes a resetting unit together with the mechanical resetting unit mentioned above.

Further, the motor drive control integrated circuit 50 has a chronograph second counter 57 counting chronograph seconds and retaining the chronograph second information, and a chronograph minute counter 58 counting chronograph minutes and retaining the chronograph minute information. There may be further provided a chronograph hour counter counting chronograph hours and retaining the chronograph hour information.

The basic drive control unit 51 receives the start signal or operation signal Pa supplied via the contact portion 34 in response to the depression of the start/stop button 18 when the chronograph timepiece 1 is in the zero-restored (reset) state S2.

Upon receiving the start signal or operation signal Pa, the basic drive control unit 51 issues a drive control signal Pd after a short period for preventing chattering. In the following, unless otherwise specified with reference to FIG. 4, etc., the point in time when the start signal or operation signal Pa is received and the point in time when the drive control signal Pd is transmitted are substantially identical with each other. The drive control signal Pd is a signal which is maintained at high level throughout the period in which chronograph operation is performed.

Further, upon receiving the stop signal Pb supplied via the contact portion 34 in response to the depression of the start/stop button 18 when the chronograph timepiece 1 is in the start state S1 (or upon the stopping of the emission of the start signal or operation signal Pa from the contact portion 34), the basic drive control unit 51 stops the transmission of the drive control signal Pd.

The drive control signal Pd from the basic drive control unit 51 is also supplied to the chronograph second counter 57; while the drive control signal Pd is maintained at high level, the chronograph second counter 57 receives clock pulses supplied from the frequency divider circuit 42 to count chronograph seconds, and, using the point in time when chronograph time measurement is started based on the drive control signal Pd as the start point, emits chronograph timing pulses Ph for each cycle T from that point in time. The cycle (chronograph hand drive cycle) T of the pulses Ph corresponds to the time measurement accuracy of the chronograph timepiece 1; it is, for example, 1/100 sec (i.e., 10 ms).

Upon receiving the drive control signal Pd, the drive pulse generation circuit 52 supplies main drive pulses G for normal chronograph hand drive to the motor drive circuit 53. The motor drive circuit 53 supplies motor drive pulses U corresponding to the main drive pulses G to the chronograph hand movement motor 35 to rotate the motor 35. From this onward, the motor 35 is alternately driven by the normal main drive pulses U (P1-1 and P1-2) of different polarities to rotate by a predetermined angle at one time.

On the other hand, upon receiving the stop signal Pb, the basic drive control unit 51 stops the emission of the drive control signal Pd (If so desired, a drive stop signal Pf may be provided), and the emission of the drive pulses G from the drive pulse generation circuit 52 is stopped, with the emission of the motor drive pulses U by the motor drive circuit 53 being stopped; the rotation of the chronograph hand movement motor 35 is stopped, and the rotation of the rotor or output shaft of the motor 35 is stopped, thus stopping the hand movement of the chronograph hands 14 and 15 via the chronograph hand movement train wheel 36.

When the switch spring 31 is pushed down through the depression of the reset button 19 and the contact portion 32 is closed, the reset signal Qa is supplied to the zero-restoring control unit 54. Upon receiving the reset signal Qa from the contact portion 32, the zero-restoring control unit 54 supplies the drive stop signal Pf to the drive pulse generation circuit 52. As a result, the drive pulse generation circuit 52 stops the generation of the drive pulses G, and stops the emission of the motor drive pulses U by the motor drive circuit 53. Thus, the rotation of the chronograph hand movement motor 35 is stopped, and the movement of the chronograph hands 14 and 15 is stopped.

Upon receiving the reset signal Qa, the zero-restoring control unit 54 resets the contents of the chronograph second counter 57 and of the chronograph minute counter 58 to zero. On the basis of the reset signal Qa based on the resetting operation on the reset button 19, the zero-restoring control unit 54 effects chronograph reset control (i.e., stops the hand movement and resets the counters).

Further, as will be described in detail below, when the motor 35 is already being driven at the time of operation of the reset button, the basic drive control unit 51 judges that non-rotation has occurred based on the result obtained by the rotation detection circuit 55, and, when the rotation detection circuit 55 detects non-rotation, it judges that it is non-rotation due to mechanical setting, and the polarity of the drive pulses to be driven by the motor drive circuit 53 is not reversed. As a result, when non-rotation due to the setting at the time of zero-restoring is detected, the driving is started at the time of restarting of chronograph measurement operation with the drive pulses U of the same phase as the previous one.

Next, regarding the chronograph timepiece 1 of FIG. 1, the operation when chronograph measurement is restarted through operation of the start/stop button 18 after non-rotation has occurred through operation of the reset button 19 mainly at the time of drive control of the motor 35, will be described specifically based on the time chart of FIG. 4.

When the reset button 19 is depressed in the direction B1, with the chronograph timepiece 1 being in the hand movement state S1 shown in FIG. 2B, the contact portion 32 is closed via the switch spring 31 as the reset button 19 is pushed down, with the result that the reset signal Qa is issued via the contact portion 32 at the point in time t0. The reset signal Qa is continued until a point in time tx up to which the closing of the contact portion 32 as a result of the depression of the reset button 19 is continued. When the reset signal Qa is supplied to the zero-restoring unit 54, the zero-restoring unit 54 supplies the zero-restoring control signal Pf to the drive pulse generation circuit 52 at t3 after a short period of time for preventing chattering.

On the other hand, when the reset button 19 is depressed in the direction B1, with the timepiece being in the hand movement state S1 shown in FIG. 2B, the protrusion 25*c* of the hammer operating first lever 25 is pressed in the direction B1 in a predetermined period of time from the point in time t1, whereby the hammer operating first lever 25 is displaced from the position J1 to the position J2. When the hammer operating first lever 25 is displaced from the position J1 to the position J2, on the one hand, the hammer operating second lever 26 engaged with the lever 25 is moved from the position K1 to the position K2, and the hammer 27 engaged with the lever 26 is moved from the position M1 to the position M2, with the second hammer 27*b* and the minute hammer 27*c* striking the second heart 22 and the minute heart 24 to zero-restore the chronograph second hand 14 and the chronograph minute hand 15; on the other hand, the lock of the arm portion 25*d* with respect to the stop lever 28 is released, and the stop lever 28 is rotated from the position E1 to the position E2, with the arm portion 28*c* being engaged with the chronograph train wheel 36 to effect setting on the train wheel 36 and to attain the reset state S2 shown in FIG. 2A.

Prior the time t0, the motor drive circuit 53 has been driven by the main drive pulse U (P1-1) of one polarity, and, at a time t2 after a predetermined period of time after the time t1, the motor 35 is driven by the main drive pulse U (P1-2) of the reverse polarity.

Since the mechanical setting of the chronograph hands 14 and 15 and the drive timing for the motor 35 overlap each other, the motor 35 is not driven by the main drive pulse U (P1-2), and the stop state is attained after the detection of non-rotation by the rotation detection circuit 55. When the rotation detection portion 55 has detected non-rotation, the basic drive control unit 51 judges it to be non-rotation due to the setting, and the reset state is attained, with the polarity of the drive pulse for the next drive not being reversed.

Figure 4:
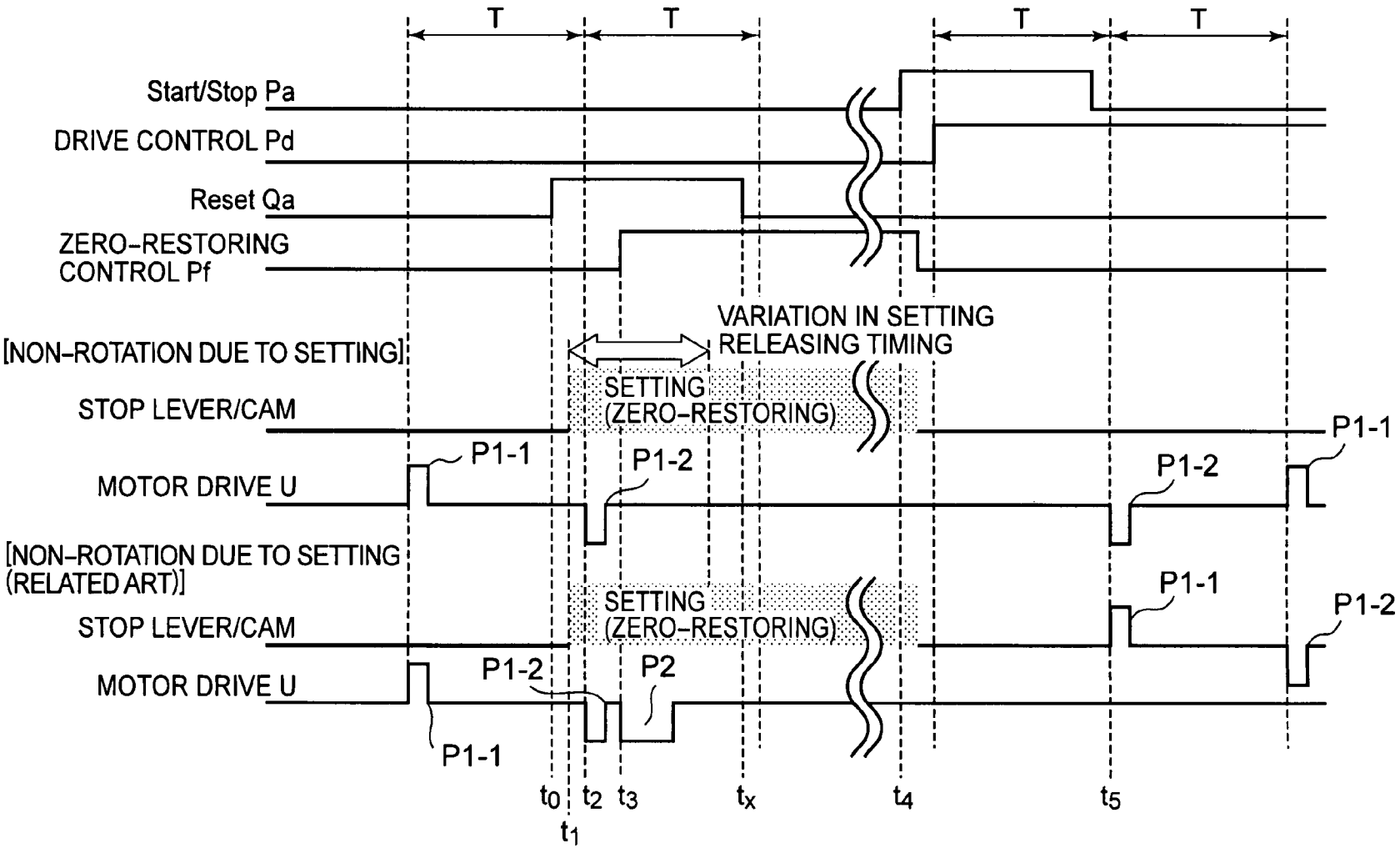
FIG. 4 is a timing chart for a chronograph timepiece according to an embodiment of the present invention.

As shown at the bottom of FIG. 4, in the related art, in the case of non-rotation due to the drive by the main drive pulse U (P1-2), forcible rotation is effected at the point in time t3 with a correction drive pulse P2 of larger energy than the main drive pulse U (P1-2); in this case also, no rotation occurs due to the setting; however, rotation is judged to have occurred, and the polarity of the drive pulse is reversed to attain the reset state.

When the start/stop button 18 is depressed in the direction A1, with the chronograph timepiece 1 being in the zero-restored (reset) state S2 shown in FIG. 2A, the contact portion 34 is closed as the start/stop button 18 is pushed down, and the start signal Pa is issued via the contact portion 34 at the point in time t4. The start signal Pa is continued until the point in time up to which the closing of the contact portion 34 as a result of the depression of the start/stop button 18 is continued. When the start signal Pa is supplied to the basic drive control unit 51, the basic drive control unit 51 starts chronograph measurement operation after a short period of time for avoiding the influence of chattering. Further, upon receiving the start signal Pa, the basic drive control unit 51 outputs the drive control signal Pd, which attains high level during driving, to the drive pulse generation circuit 52.

At a point in time t5 after the elapse of the chronograph drive cycle T since the start of chronograph measurement, the drive pulse generation circuit 52 generates the drive pulse G so as to drive the motor with the main drive pulse U (P1-2) of the same polarity as that of the main drive pulse U (P1-2) for the previous resetting, generating the motor drive pulse U (P1-2) of a polarity corresponding to the drive pulse G in the motor drive circuit 53. In this way, driving is effected by a main drive pulse U (P1-2) of the same polarity as that of the main drive pulse U (P1-2) not used for driving at the time of the previous resetting, so that the hand movement can be effected in the normal fashion. After this, for each chronograph time measurement cycle T, driving is effected alternately with main drive pulses U (P1-1 and P1-2) of different polarities to thereby perform the hand movement operation.

On the other hand, in the case of the conventional drive control, as shown at U (related art) at the bottom of FIG. 4, driving is effected at a point in time t5 after the elapse of the cycle T after the point in time when chronograph measurement operation is resumed, using the main drive pulse P1-1 of an opposite polarity to the main drive pulse P1-2 used for the previous resetting as the motor drive pulse U (related art), so that a state is caused in which non-rotation occurs to make it impossible to effect hand movement, whereas, as described above, in the chronograph timepiece of this embodiment, driving is effected with a main drive pulse U (P1-2) of the same polarity as the main drive pulse U (P1-2) not used for the previous resetting, so that it is possible to effect the hand movement in the normal fashion. As a result, it is possible to realize an accurate hand movement of the chronograph hands 14 and 15.

Figure 1:
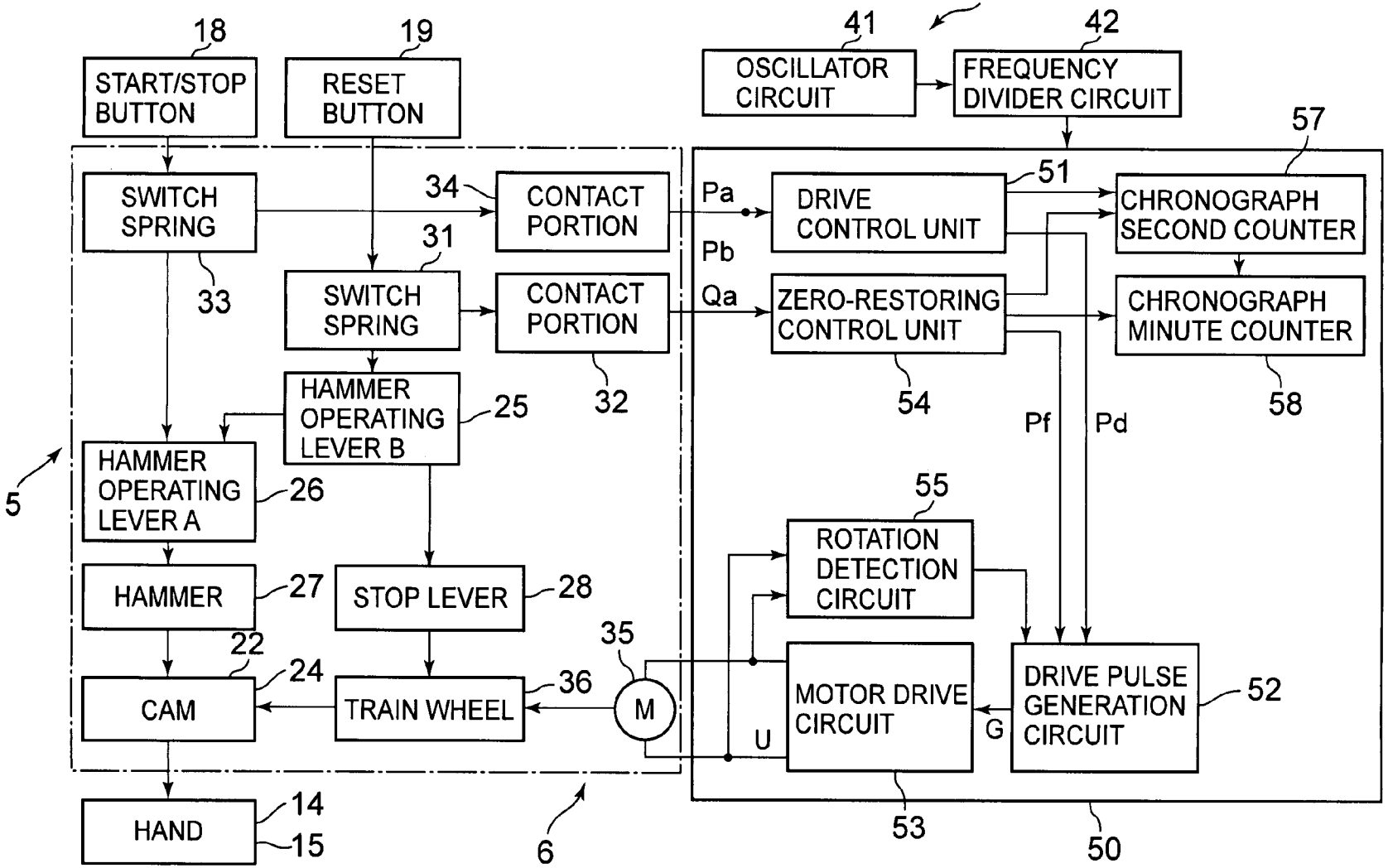
FIG. 1 is a block diagram showing a chronograph timepiece according to an embodiment of the present invention.
Figure 5:
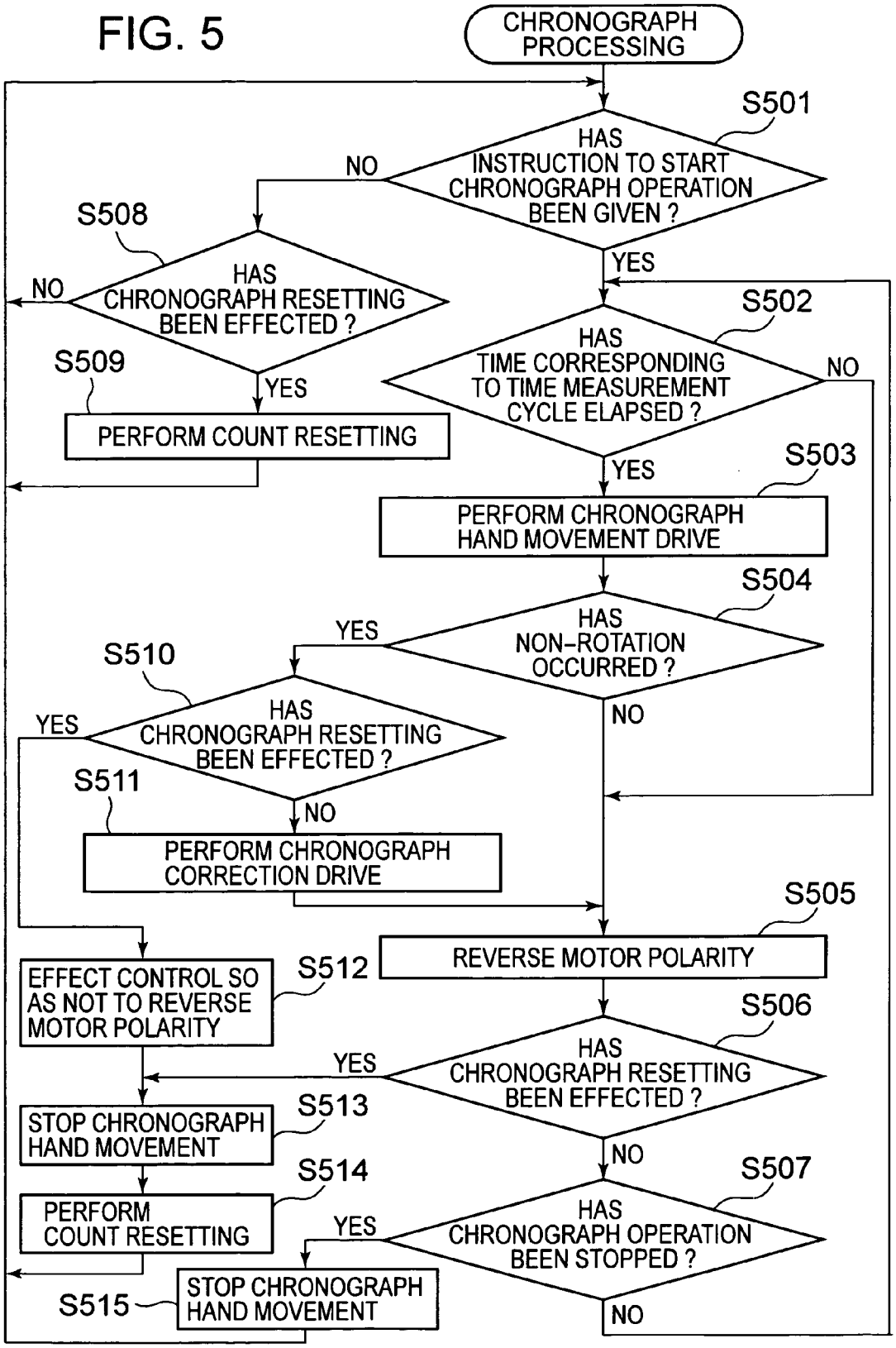
FIG. 5 is a flowchart for an embodiment of the present invention.

Next, the operation of the chronograph timepiece 1 constructed as described above will be illustrated mainly with reference to the flowchart of FIG. 5 while also referring to FIGS. 1 through 4. In this flowchart, the operation of mainly the basic drive control unit 51 of the integrated circuit 50 of the chronograph timepiece 1 of FIG. 1 is shown as a program flow corresponding to the operation.

In the chronograph timepiece 1, the basic drive control unit 51 checks, in the first processing step S501, as to whether or not an instruction to start chronograph operation has been given. The start checking step S501 corresponds to the checking as to whether or not the operation signal or start signal Pa has been supplied to the basic drive control unit 51 of the integrated circuit 50 from the contact portion 34 through displacement in the direction A1 of the switch spring 33 caused by the depression in the direction A1 of the start/stop button 18 to close the contact portion 34 for contact.

When no start signal Pa has been issued, the zero-restoring unit 52 checks in step S508 as to whether or not an instruction for resetting (zero-restoring) has been given. The reset checking step S508 corresponds to the checking as to whether or not the reset signal Qa has been supplied to the zero-restoring unit 54 of the integrated circuit 50 from the contact portion 32 through displacement in the direction B1 of the switch spring 31 caused by the depression in the direction B1 of the reset (zero-restoring) button 19 to close the contact portion 32. When no reset signal Qa has been issued, the procedure returns to the first processing step S501. When the reset signal Qa has been issued, the zero-restoring control unit 54 performs in step S509 the count resetting processing to zero-restore the contents of the chronograph second counter 57 and of the chronograph minute counter 58; then, the procedure returns to the first processing step S501.

When an instruction to start chronograph operation (start signal Pa) is confirmed in the start checking step S501, the basic drive control unit 51 checks in step S502 as to whether or not a period of time corresponding to the time measurement cycle T of the chronograph operation (which, in this example, is, e.g., 1/100 sec, i.e., 10 ms) has elapsed. When the time measurement cycle T has been attained, the procedure advances to step S503. This corresponds to the fact that the period of time after the time measurement start of the chronograph operation is measured by the chronograph second counter 57; when the time corresponding to the time measurement cycle T is attained, a timing pulse Ph is issued.

When the period of time T has elapsed, the drive pulse generation circuit 52 supplies the drive pulse G to the motor drive circuit 53 so as to hand-movement-drive the chronograph hands 14 and 15, and the motor drive circuit 53 supplies a motor drive pulse U corresponding to the drive pulse G to the chronograph hand movement motor 35 to thereby rotate the motor 35 (step S503).

When the rotation detection circuit 55 judges the motor 35 to have been rotated (step S504), the basic drive control unit 51 effects control such that the drive pulse generation circuit 52 reverses the polarity of the drive pulse G to be used for the next drive (step S505), and then the zero-restoring control unit 54 judges whether or not resetting operation has been performed on the reset button 19 (step S506). When it has been judged in step S506 that no resetting operation has been performed on the reset button 19, the zero-restoring control unit 54 next judges in step S507 whether or not stop operation has been performed. When it is judged that no stop operation has been performed on the start/stop button 18, the procedure of the basic drive control unit 51 returns to step S502; when stop operation has been performed thereon, it stops the driving of the chronograph hands 14 and 15 (step S515), with the procedure returning to step S501.

In the case in which the rotation detection circuit 55 judges non-rotation to have occurred in step S504, when the zero-restoring judging unit 54 judges no resetting operation to have been performed on the reset button 19 (step S510), the drive pulse generation circuit 52 performs driving with correction drive pulses, and then the procedure advances to step S505 (step S511).

When it is judge in step S510 that resetting operation has been performed on the reset button 19, the basic drive control unit 51 effects control such that the drive pulse generation circuit 52 does not reverse the polarity of the drive pulse U to be used for the next drive (i.e., it does not perform the control to effect reversing) (step S512), and the zero-restoring control unit 54 stops the driving of the chronograph hands 14 and 15 (step S513); at the same time, the chronograph second counter 57 and the chronograph minute counter 58 are reset (step S514), and then the procedure returns to step S501. When, after this, start operation is performed on the start/stop button 18 to restart the processing of step S501 onward, the rotation is effected at the time of the first motor drive with a main drive pulse of the same polarity as that of the drive pulse at the time of resetting, so that it is possible to rotate the motor 35 in the normal fashion.

When in step S506 the zero-restoring control unit 54 judges that resetting operation has been performed, procedure advances to step S513.

As described above, when resetting operation is performed on the reset button 19 during the driving of the motor 35, and the rotation detection circuit 55 detects non-rotation, the drive control unit 51 ends its control without reversing the polarity of the motor drive pulse G output from the drive pulse generation circuit 52, and, in response to start operation on the start/stop button 18, controls the drive pulse generation circuit 52 such that the motor drive circuit 53 drives the motor 35 with a drive pulse U of the same polarity as that of the drive pulse for the previous resetting, driving the motor 35 at the time of starting after the resetting with the above-mentioned drive pulse U of the same polarity.

Thus, in the related art, when resetting operation is performed during chronograph measurement, the drive timing for the motor 35 and the timing of the zero-restoring operation overlap each other, so that rotation is not effected at the time of the first drive when chronograph measurement operation is restarted, making it impossible to effect hand movement, whereas, in this embodiment, it is possible to prevent non-rotation from occurring at the time of the first drive when performing the next starting operation even when resetting is effected during the driving of the motor, so that the motor can be reliably driven when effecting restarting after the resetting, making it possible to perform an accurate hand movement.

While in the above-described embodiment the chronograph second hand is arranged on the 6 o'clock side, and the chronograph minute hand is arranged on the 9 o'clock side, the present invention may also be applied to a center chronograph timepiece using the hand 13 as the chronograph second hand.

The present invention is applicable to various types of chronograph timepieces in which the driving of the time hands and the chronograph hands are electrically effected by a motor and in which, in the reset state, setting is effected by a mechanical mechanism so that the chronograph hands may not move, with the driving of the chronograph hands being effected after releasing the setting by the mechanical mechanism.

What is claimed is:

1. A chronograph timepiece comprising: a chronograph hand indicating time measured at the time of chronograph measurement; a stepping motor rotating the chronograph hand; operating means performing operations of starting, stopping, and resetting chronograph measurement; rotation detecting means detecting whether the stepping motor has rotated or not; drive control means which drive-controls the stepping motor in response to an operation by the operating means and which drive-controls the stepping motor by a drive pulse in accordance with a detection result obtained by the rotation detecting means; and resetting means which mechanically zero-restores and retains the chronograph hand in response to the resetting operation by the operating means and which electrically resets chronograph measurement operation, wherein, when the resetting operation by the operating means is conducted at the time of driving the stepping motor, and the rotation detecting means detects non-rotation, the drive control means drive-controls the stepping motor by a drive pulse of the same polarity as that at the time of previous resetting in response to the restarting operation by the operating means.

2. The chronograph timepiece according to claim 1, wherein the operating means includes a reset button; and the resetting means comprises: mechanical resetting means having lever means displaced in response to the resetting operation of the reset button and a cam zero-restoring and retaining the chronograph hand in response to the displacement of the lever means; and electrical resetting means resetting a chronograph time measurement counter in response to the resetting operation of the reset button.

* * * * *